United States Patent [19]

Focke et al.

[11] Patent Number: 4,918,908

[45] Date of Patent: Apr. 24, 1990

[54] APPARATUS FOR FEEDING BLANKS TO A FOLDING TURRET OF A PACKAGING MACHINE

[75] Inventors: Heinz Focke; Helmut Granz, both of Verden, Fed. Rep. of Germany

[73] Assignee: Focke & Co. (GmbH & Co.), Verden, Fed. Rep. of Germany

[21] Appl. No.: 268,304

[22] Filed: Nov. 7, 1988

[30] Foreign Application Priority Data

Nov. 10, 1987 [DE] Fed. Rep. of Germany ..... 3738102

[51] Int. Cl.[5] ..... B65B 13/20

[52] U.S. Cl. ..... 53/579; 53/202; 53/234; 53/389

[58] Field of Search ..... 53/202, 234, 579, 389, 53/230

[56] References Cited

U.S. PATENT DOCUMENTS

| | | | |
|---|---|---|---|
| 788,494 | 4/1905 | Placer | 53/202 |
| 4,258,528 | 3/1981 | Focke | 53/579 X |
| 4,308,708 | 1/1982 | Focke | 53/202 X |
| 4,730,442 | 3/1988 | Focke et al. | 53/579 |

*Primary Examiner*—John Sipos

*Attorney, Agent, or Firm*—Sughrue, Mion, Zinn, Macpeak & Seas

[57] ABSTRACT

To increase the output of a packaging machine especially for hinge-lid packs produced from individual blanks, the latter are fed to folding members (folding turret 31) along two parallel tracks (blank tracks 39, 40). To guarantee faultless and efficient conveyance of two blanks at a time, the blank tracks (39, 40) are arranged at a distance from one another which is greater than the distance between pockets (32, 33) of the folding turret (31), into which the blanks are to be introduced simultaneously. As a result of a transversely directed movement, the blanks are moved toward one another into the position for pushing into the pockets (32, 33).

13 Claims, 11 Drawing Sheets

APPARATUS FOR FEEDING BLANKS TO A FOLDING TURRET OF A PACKAGING MACHINE

DESCRIPTION

The invention relates to an apparatus for feeding blanks to a packaging unit, especially a folding turret, with pockets, each receiving a blank, the blanks being conveyable into a position above a pocket of the folding turret and being pressable into the upwardly open pocket as a result of the downward movement.

The subject of the invention is the production of packs from foldable material, especially so-called hinge-lid packs, which are used predominantly for cigarettes. The apparatus starts from a packaging machine according to DE-A-2,440,006. In this known packaging machine, the blanks extracted from a magazine are conveyed into a position above a pocket of the folding turret and are then pressed downwards to the pocket by a ram. During this downward movement of the blank, parts of the blank are erected as a result of a relative movement in relation to folding members fixed location, so that the blank is received in the pocket in an L-shaped position. At the same time, lateral parts have likewise been folded into an erect position. In further stations of the intermittently rotating folding turret, the pack is then filled and ready-folded.

The invention is concerned with an apparatus of the above-described or similar type. The object on which the invention is based is to increase the productive capacity of a packaging machine of this type or of the packaging unit.

To achieve this object, the invention is characterized by the following features:

(a) The blanks can be pressed in pairs into two respective pockets of the folding turret which are arranged next to one another, (b) the blanks can be fed on separate (parallel) blank tracks, the distance between these being greater than the distance between the pockets of the folding turret which are to be fed simultaneously, (c) the blanks, immediately before entering the pockets, can be moved towards one another on transverse tracks to a distance from one another corresponding to the distance between the pockets, in order to be pushed simultaneously into the pockets.

The apparatus according to the invention accordingly starts from a folding turret with parallel pockets arranged respectively in pairs next to one another and each receiving a blank or a pack. Accordingly, two blanks at a time have to be conveyed simultaneously into a position above the disc-shaped folding turret and pressed into the open pockets from above. According to the invention, the blanks are conveyed at a relatively long distance from one another on parallel blank tracks up to an end position and are then moved transversely towards one another. As a result of this cycle of movement or this angular conveying path for the blanks it is possible for the two blanks to be positioned extremely accurately above the respective associated pockets, specifically at high conveying speeds corresponding to the high output of the packaging machine.

According to a further feature of the invention, the blanks are pressed into the pockets from above by two rams actuated simultaneously, especially connected to one another, folding tabs or blnk parts thereby being erected. The abovementioned "double ram" is actuated as a single unit, thus guaranteeing that the cycle of movement will be simultaneous.

In the region of the parallel blank tracks arranged at a distance from one another, the blanks are transported by means of conveying rollers. According to the invention, in the region of the transverse tracks are arranged endless conveyors, especially two respective parallel toothed belts which have drivers, each for grasping a blank on the longitudinal sides.

Further features of the invention relate to the design of the conveying members and of folding members which are activated in conjunction with the pressing of the blanks into the pockets.

An exemplary embodiment of the apparatus according to the invention is explained in detail below with reference to the drawings In these:

Figure 2:
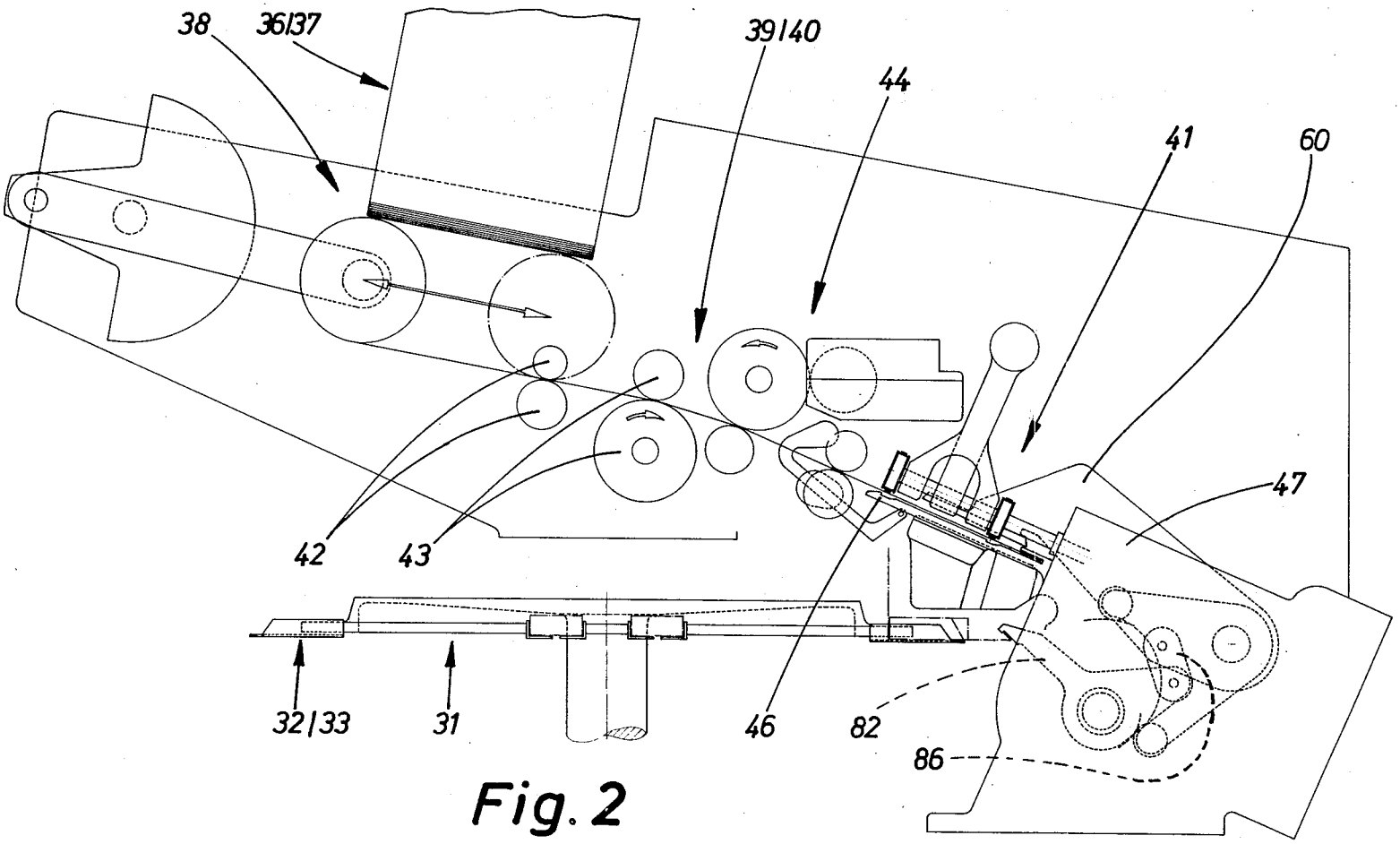
FIG. 2 shows a diagramatic side view of the apparatus as as whole.
Figure 3:
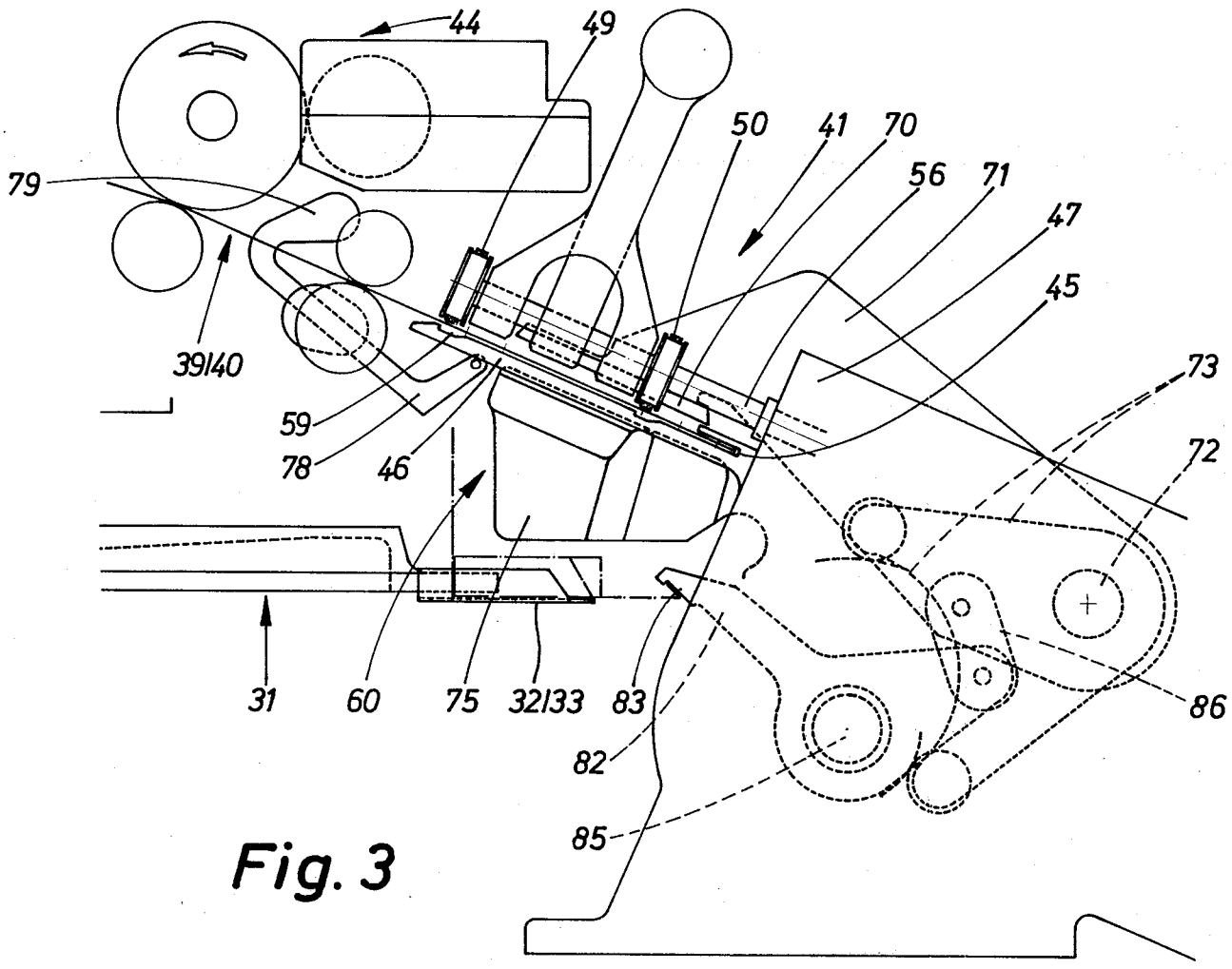
Figure 4:
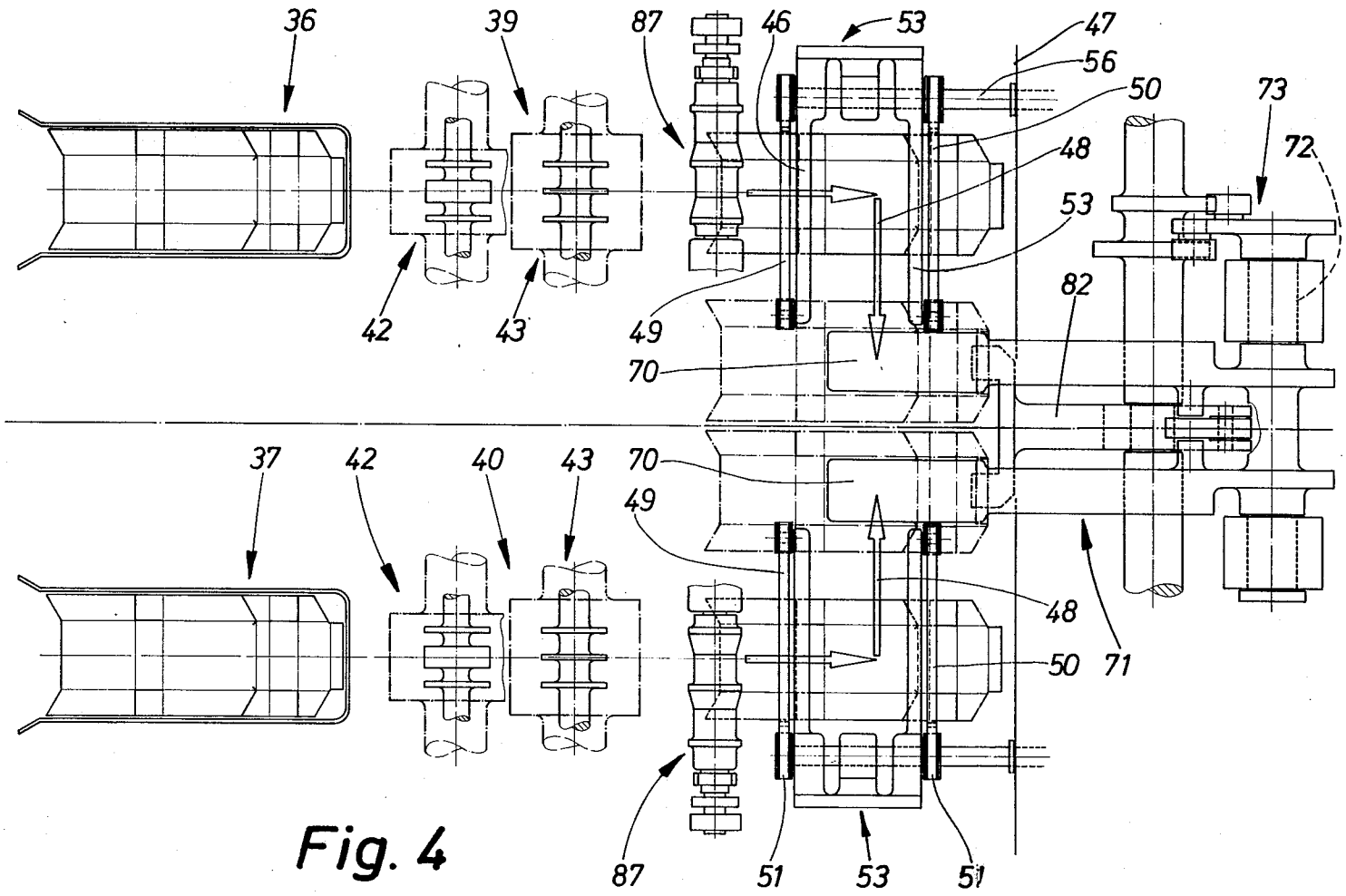
Figure 5:
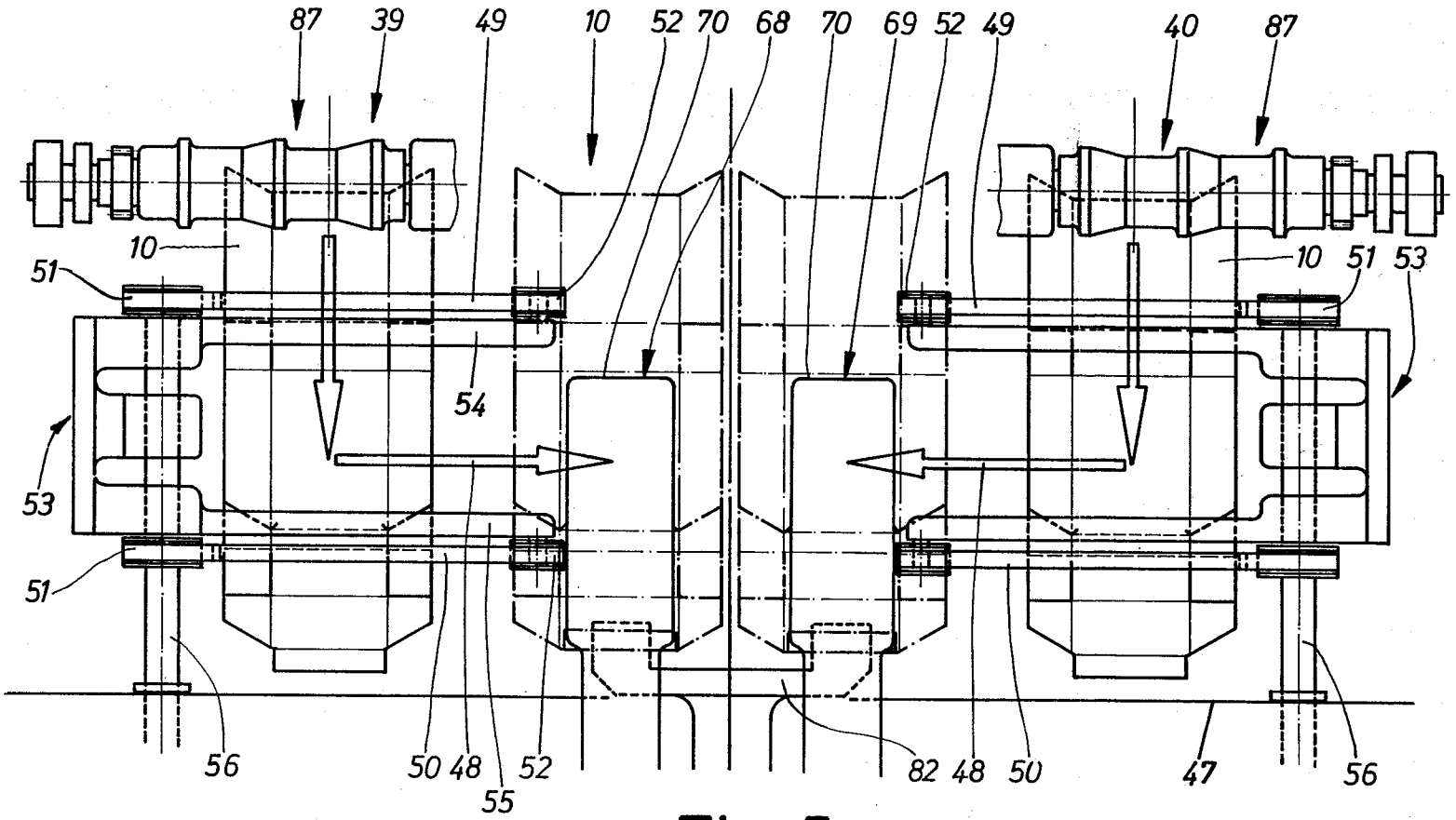
Figure 6:
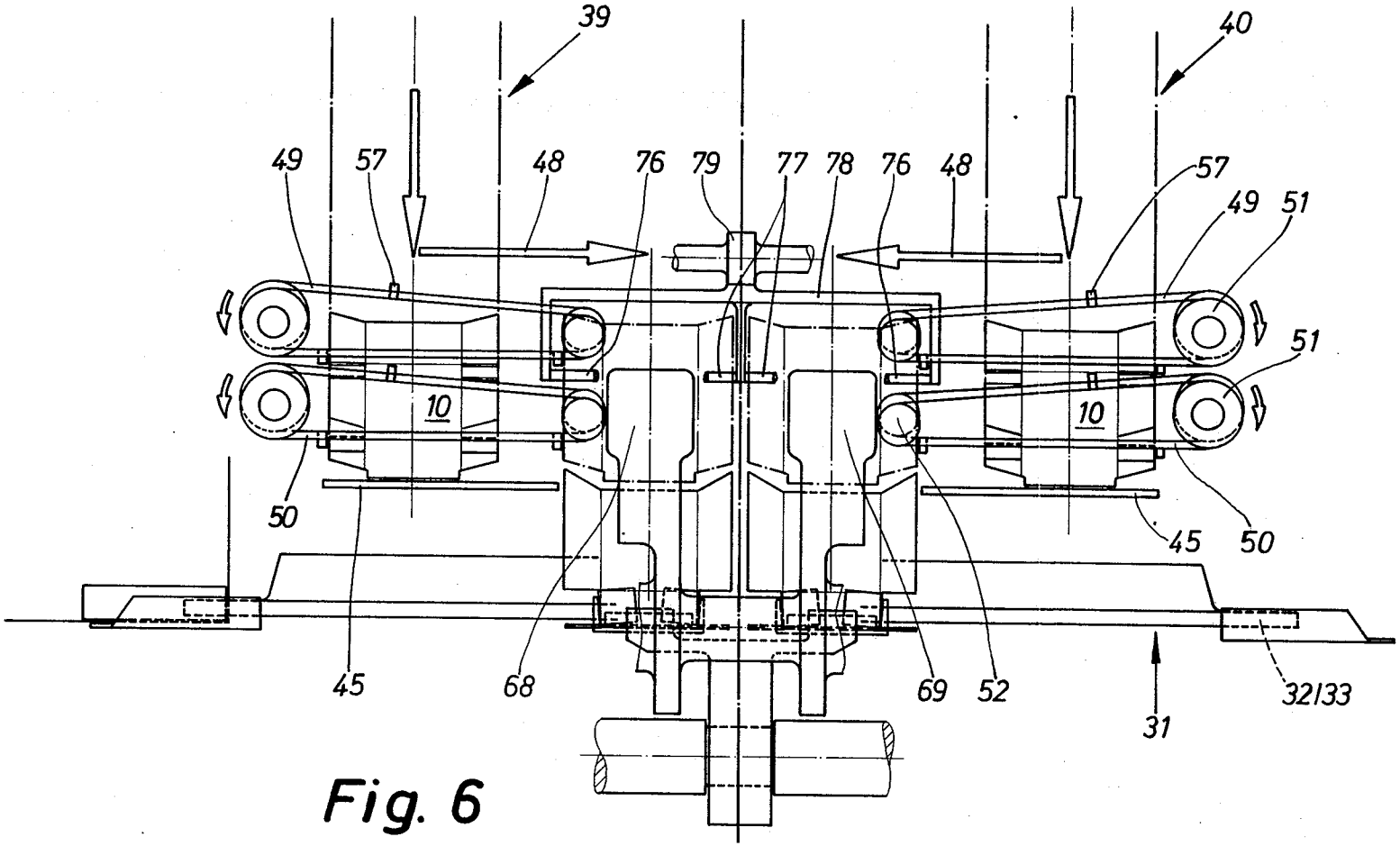
Figure 7:
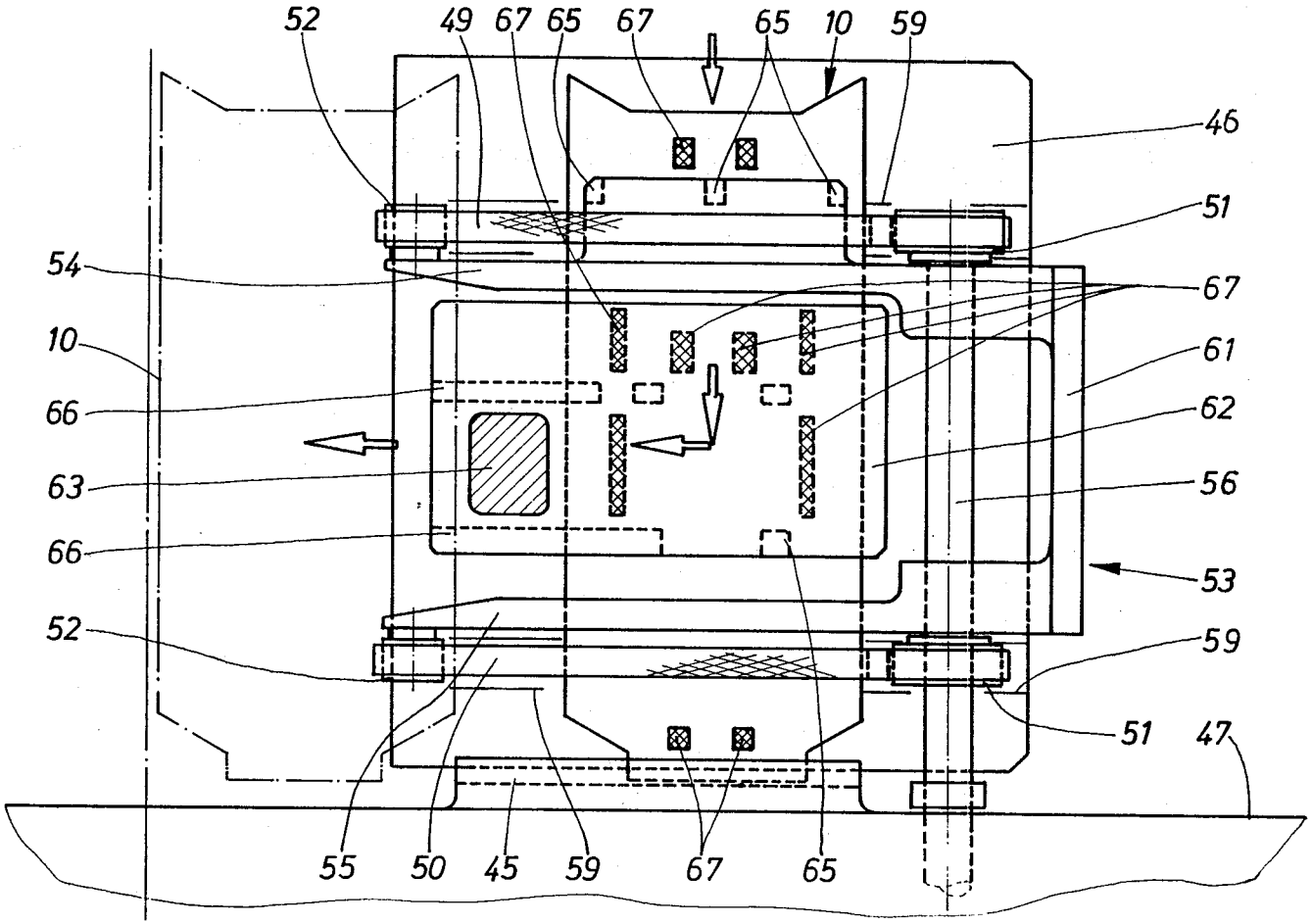
Figure 8:
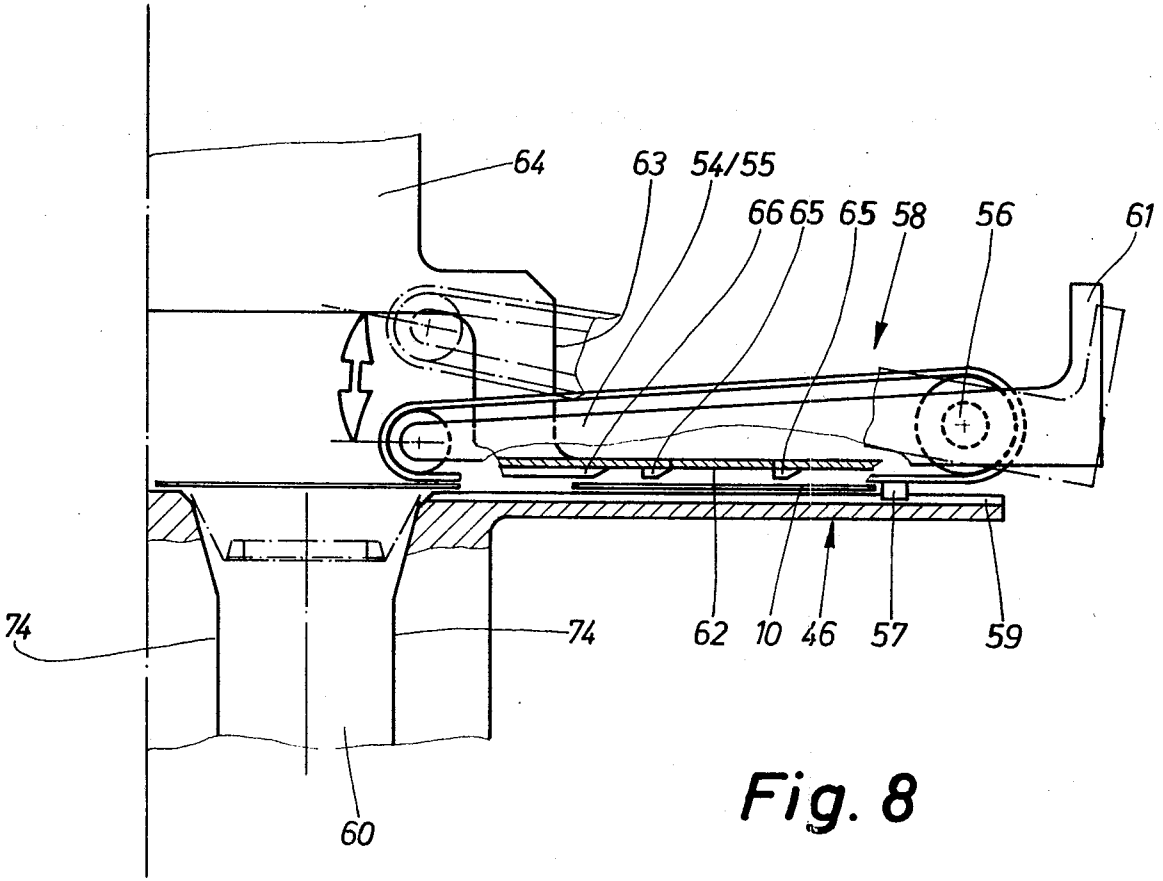
Figure 9:
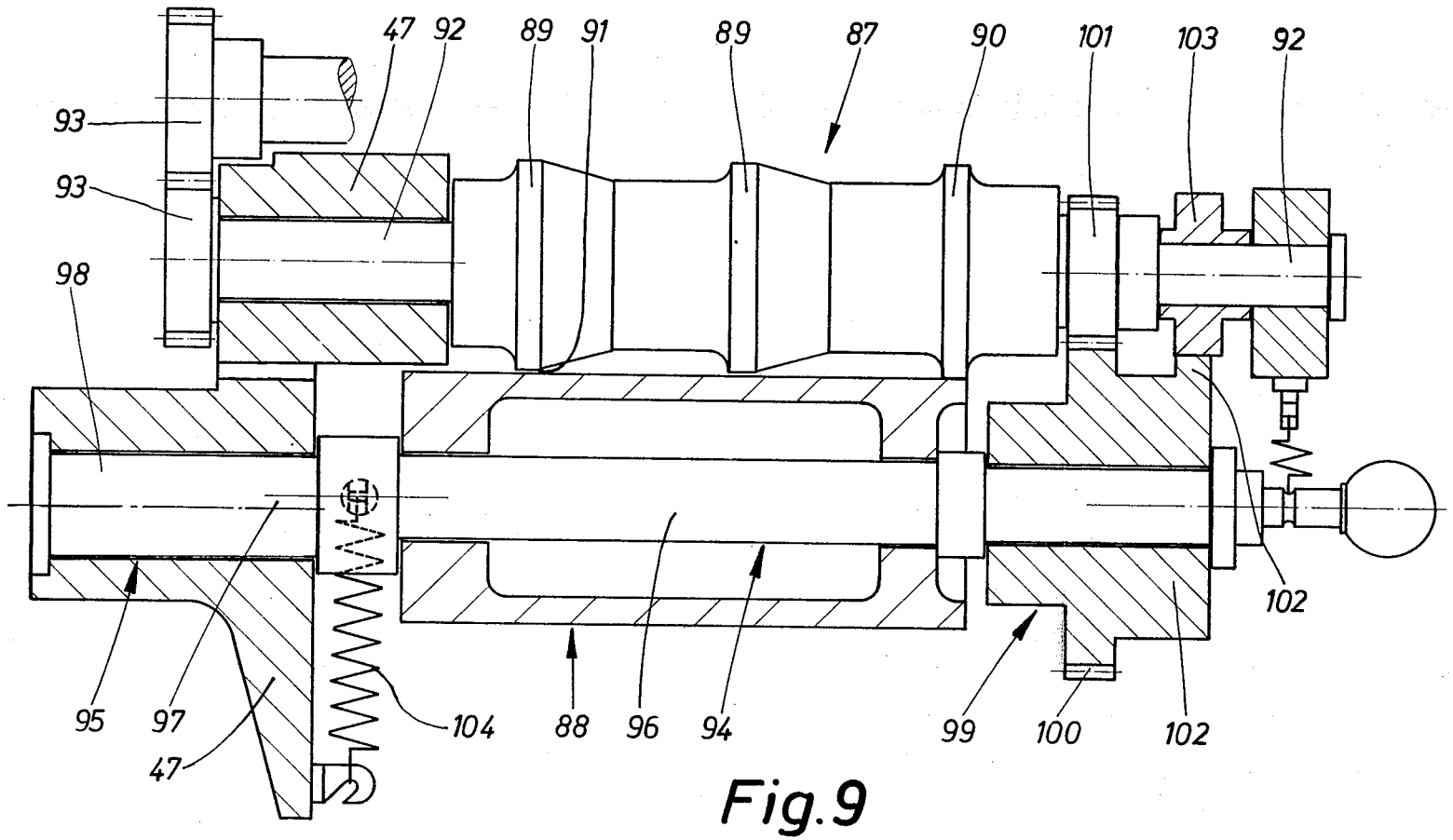
Figure 10:
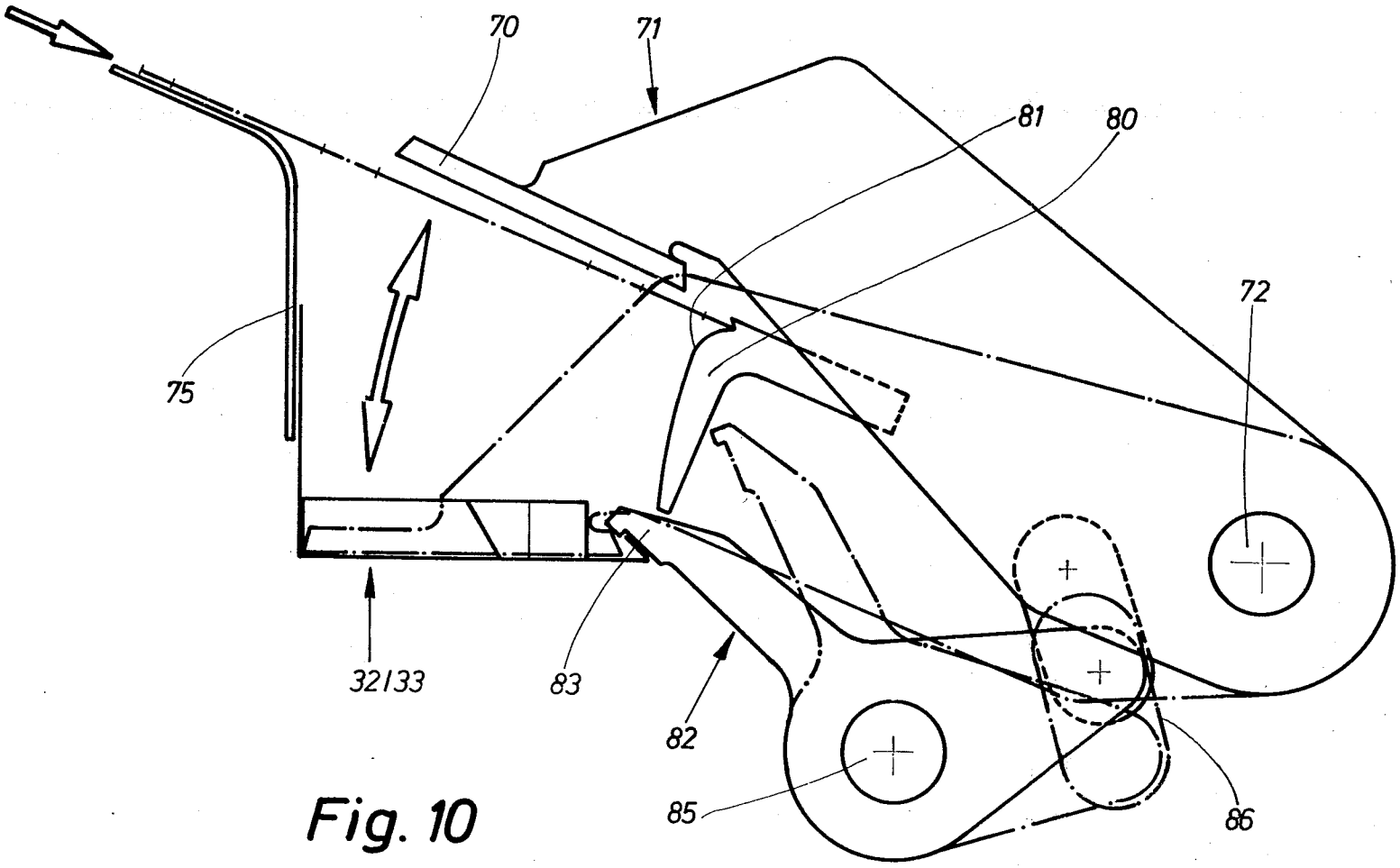
Figure 11:
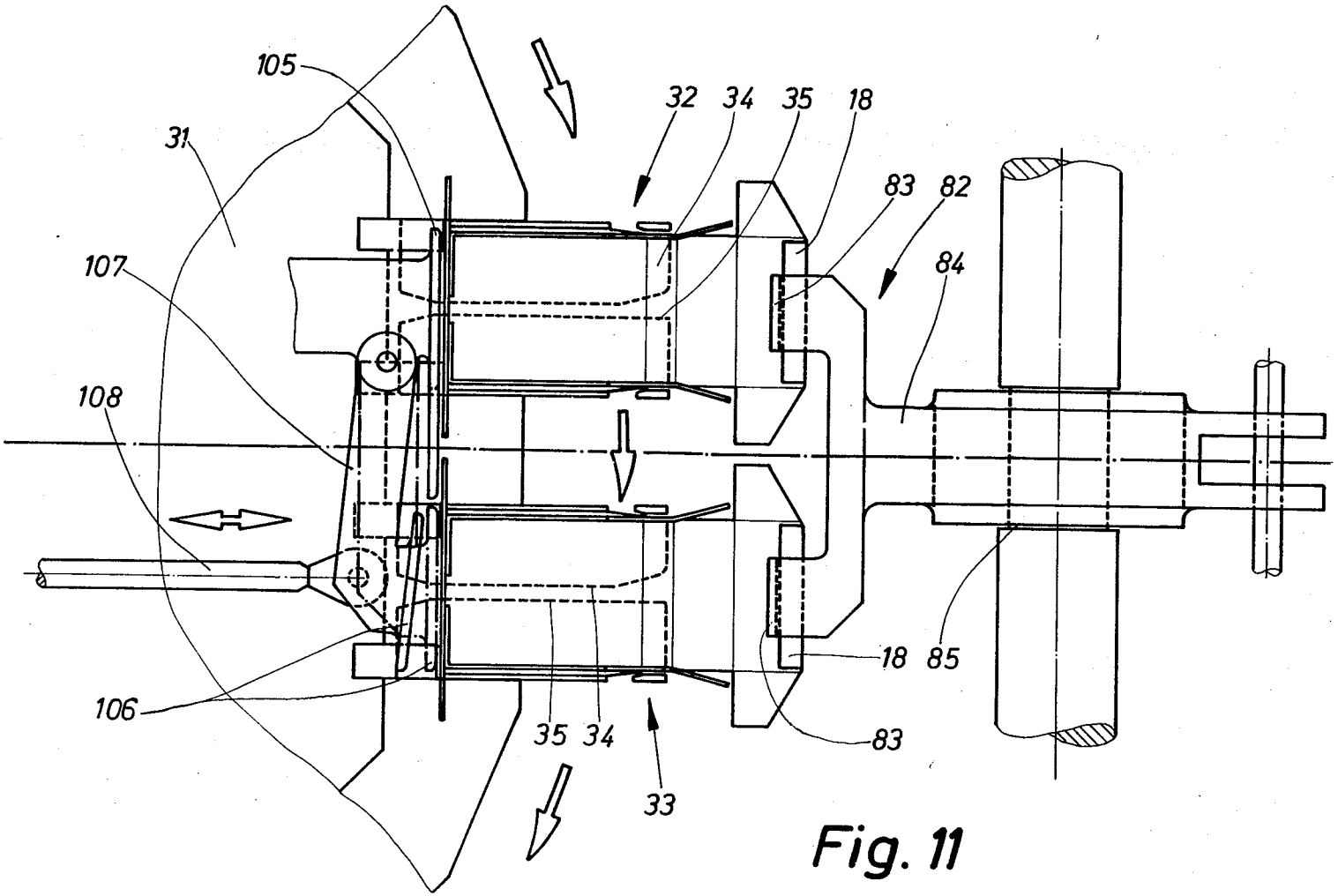

FIG. 3 shows a cutout from the apparatus in a representation corresponding to that of FIG. 2 and on an enlarged scale, FIG. 4 shows the apparatus according to FIG. 2 in a simplified horizontal projection, FIG. 5 shows a cutout from the apparatus according to FIG. 4 on an enlarged scale, FIG. 6 shows an end view of part of the apparatus, FIG. 7 shows part of a pushing-in station in horizontal projection, FIG. 8 shows the detail according to FIG. 7 in a side view and in section, FIG. 9 shows a further detail of the pushing-in station, in particular a conveying roller with a backing roller, in a side view and in longitudinal section on an enlarged scale, FIG. 10 shows a diagramatic side view of a detail of the apparatus in the region of a pocket of a folding turret, FIG. 11 shows the detail according to FIG. 7 in horizontal projection.

Figure 1:
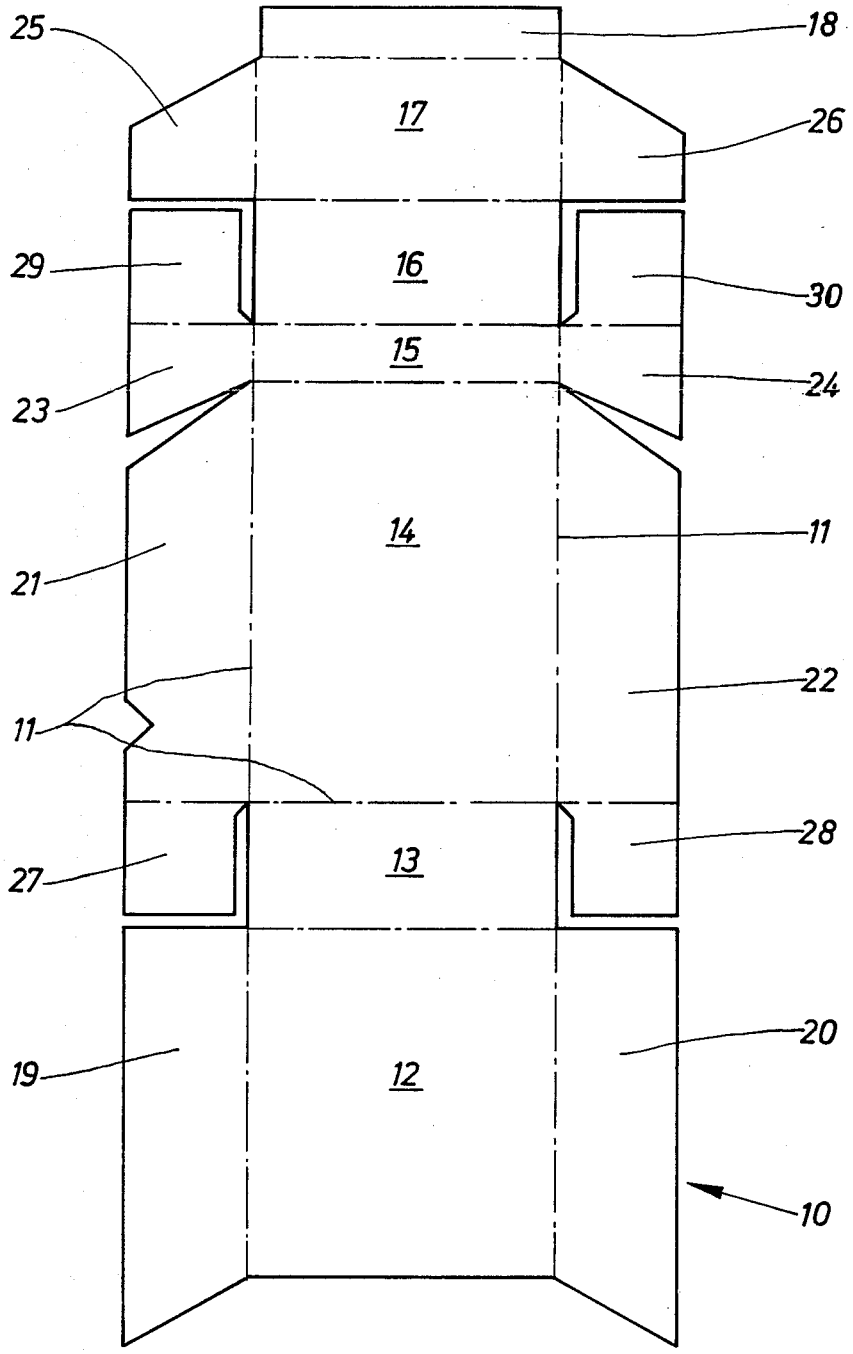
FIG. 1 shows a spread-out blank for the production of hinge-lid packs.

The apparatus illustrated is part of a packaging machine especially for the production of hinge-lid packs and having individual features according to DE-A-2,440,006. FIG. 1 shows a blank 10 from which packs of this type are produced. The blank 10 consists of thin foldable cardboard. Dot-and-dash lines are folding lines 11, in the region of which the blank 10 is folded to form the pack. The folding lines 11 define folding tabs or pack parts, specifically a front wall 12, a bottom wall 13, a rear wall 14, a lid rear wall 15, a lid top wall 16 and a lid front wall 17 in particular. The abovementioned wall parts are arranged in succession in the longitudinal direction of the blank 10. An inner lid tab 18 which is folded against the inner face of the lid front wall 17 in order to reinforce the latter adjoins the free edge of the lid front wall 17.

Side walls of the (finished) pack are formed from side tabs, specifically from outer side tabs 19 and 20 connected to the front wall 12 and from inner side tabs 21 and 22 adjoining the rear wall 14 laterally. In the finished pack, the abovementioned side tabs 19 to 22 rest against one another and are connected to one another by adhesive bonding. In the region of a hinge lid, lid side walls are formed from inner lid side tabs 23,24 of the lid rear wall 15 and from outer lid side tabs 25,26 of the lid front wall 17, likewise by folding them one over the other.

In the region of the bottom wall 13, in particular adjacent to this, bottom corner tab 27,28 are formed, specifically in the extension of and connected to the inner side tabs 21,22. In the finished pack, the bottom corner tabs 27,28, folded through 90°, rest against the inner face of the bottom wall 13. Correspondingly, lid corner tabs 29,30 are formed in the region of the lid top wall 16.

To produce the hinge-lid packs from a blank 10 of this type, there is primarily a folding turret 31 which is rotatable as flat disc-shaped structure about the vertical axis. The folding turret 31, along the circumference, is equipped with a multiplicity of pockets, 32,33, each receiving a blank or a pack. A particular feature of the folding turret 31 is that two pockets 32,33 of this type are arranged respectively next to and parallel to one another, receiving and processing two blanks 10 simultaneously. The output of the folding turret 31 is therefore doubled in relation to the apparatus according to DE-A-2,440,006. The members assigned to the pockets 32,33 can, unless illustrated or described otherwise, be designed in the same way as, or similarly to those on the abovementioned known packaging machine. Here, the pockets 32,33 themselves each consist of two supporting legs 34 and 35 which are directed parallel to the radial plane and which form a receptacle for the blank 10 which is open at the top and on the radially outer sides.

In the present exemplary embodiment, the blanks 10 are accommodated as stacks in two magazines 36,37. A blank 10 is extracted simultaneously on the underside of each of the magazines 36,37, specifically by means of a rolling-off device 38 of known design and mode of operation.

A separate blank track 39,40 is assigned to each of the magazines 36,37 and consequently to each of the blanks 10 to be processed simultaneously. The two blank tracks 39,40 extend parallel to one another at a distance which is considerably greater than the distance between the pockets 32 and 33. It is thus possible to convey the blanks 10 satisfactory in the region of the two blank tracks 39,40 without their interferring with one another.

The blank tracks 39,40 are designed to extend obliquely downwards from a higher position and terminate in the region of a pushing-in station 41 above a pair of pockets 32,33 to be fed. In the region of the blank tracks 39,40, the blanks 10 are conveyed by means of pairs of transport rollers 42 and 43. Above each blank track 39,40 is located a glueing unit 44, by means of which glue is transferred to the individual regions of the blanks 10 in a known way.

Blanks 10 are transported with their longitudinal extension pointing in the conveying direction, specifically with the lid front wall 17 or the inner lid tab 18 pointing forwards. At the end of the blank tracks 39,40 is arranged a limit stop 45 aligned with the folding turret 31 as intended for each blank.

In the end position, the blanks 10 each rest on a stationary platform 46 forming the end of the blank track 39,40. This platform 46, in one piece with the limit stop 45, is mounted on the machine stand 47 so as to project on one side.

The two blanks 10, resting on the platforms 46, are now moved towards one another in the transverse direction (arrow 48), specifically in coordinated simultaneous cycles of movement. The transverse movement or transversely directed parallel displacement of the two blanks 10 leads to a pushing-in position (for example, in the middle in FIG. 5). In this position, the two blanks 10 are arranged and aligned exactly above the pockets 32, 33 to be fed or above a pushing-in shaft forward by folding members. The two blanks 10 are now pressed simultaneously into the associated pockets 32,33 as a result of a downward movement, specifically with blank parts simultaneously being erected and folded.

For the transverse movement of the blanks 10 according to the arrow 48, transverse conveyors are assigned to each blank track 39,40. In the exemplary embodiment illustrated, these each consist of two endless conveyors in the form of toothed belts 49,50. These are each guided by means of drive wheel 51 arranged next to the blank track 39,40 and by means of an opposite deflecting wheel 52. The drive wheel 51 and deflecting wheel 52 are mounted on the supporting structure 53 which is arranged above each of the blank tracks 39,40. The supporting structures 53 are mounted in a stationary manner laterally next to the blank tracks 39,40 and project by means of transversely directed supporting arms 54,55 over and beyond the blank tracks 39,40 in the direction of the pushing-in position of the blanks 10. The drive wheels 51 and deflecting wheels 52 are mounted laterally on the supporting structure 53 or on the ends of the supporting arms 54,55. The supporting structure 53 is mounted on the machine stand 47 via a drive shaft 56.

For transporting the blanks 10 on the platforms 46 in the direction of the arrow 48, the toothed belts 49, 50 have drivers 57 on the outer face. The arrangement of the toothed belts 49,50 above the platforms 46 is such that the blanks 10 are conveyed by means of a lower strand 58 which runs at a short distance above the platform 46. The latter is equipped, in the region of the path of movement of the drivers 57, with a groove 59 extending in the conveying direction, specifically in the region of each toothed belt 49,50. The platforms 46 directly adjoin lateral limitations of the pressing-in shaft 60 for the blanks 10 above the folding turret 31.

The supporting structure 53 for the toothed belts 49,50 is carried solely by the drive shaft 56. As a result, the supporting structure 53 designed as a two-armed lever is supported as a result of its own weight in the conveying position, resting on the platform 46. A counterweight 61 determines the bearing pressure for the two belts 49,50. Should a build-up of material occur in the region of the platforms 46, the supporting structure 53 can be (manually pivoted) (the position represented by dot-and-dash lines in FIG. 8). The build up of material can then be eliminated easily.

In the region of the pushing-in station 41, the blanks 10 have an upper guide assigned to them. This consists of a top plate 62 arranged at a distance above the platforms 46. This top plate 62 is mounted in a stationary manner on a supporting arm 63 which itself is connected to a fixture 64 located on the machine stand 47. Attached to the underside of the top plate 62, facing the blank 10, are guide projections 65 and guide webs 66 which are at only a short distance from the blank 10 on the platform 46 and which contribute to the exact positioning and movement of the blank 10. The guide projections 65 and guide webs 66 are designed and arranged in a special way, in particular so that glue spots 67 applied to the top side of the blank 10 are not smudged by the guide projections 65 and guide webs 66 either during the conveyance of the blanks 10 into the pushing-in station 41 or during the transverse movement in the direction of the arrow 48. The elongate guide webs 66 are assigned to the pressing-in shaft 60 and ensure exact position of the blanks 10 in this region before entry into the pressing-in shaft 60.

In the pushing-in position (in the middle of FIG. 5), the blanks 10 are aligned exactly and at a short distance from one another above the associated pressing-in shaft 60. The downwardly directed pressing into the pockets 32,33 is carried out by rams 68,69 assigned to each blank 10. These each have a ram plate 70 which, during the downward movement, grasps a region of the blank 10 to be introduced into the horizontal part of the pocket 32,33, essentially the surface of the rear wall 14, of the lid rear wall 15, of the lid top wall 16 and of the lid front wall 17. The two ram plates 70 are combined, outside the region of the blanks 10, to form a unitary member, in particular a double ram 71. This is mounted on a main shaft 72 which is driven via a crank mechanism 73 in such a way that an up-and-down movement of the double ram 71 together with the rams 68 and 69 takes place specifically out of the upper initial position, visible in FIG. 3, above the fed blanks 10 into the plane of the pockets 32,33.

The blanks 10 taken along during the downward movement of the rams 68,69 are folded into an erect position by stationary, lateral folding members, in particular by side folders 74 and by a radially inner folding wall 75 (FIG. 10). During the downward movement of the blank 10, the downwardly converging wall-shaped side folders 74 put the side tabs 21 and 22, the lid side tabs 23 and 24 and the lid corner tabs 29,30 into an erect position. By means of the folding wall 75 directed transversely to this, a part of the blank 10 consisting of the bottom wall 13, of the front wall 12 and of side tabs 19,20 is likewise erected during the downward movement.

During this erecting folding, the bottom corner tab 27,28 is not only erected, but already brought into the end position resting against the inner face of the bottom wall 13. For this purpose, the bottom corner tabs 27, 28 of the two blanks 10 are prefolded, in particular erected slightly, by a separate folding member before the downward movement. This folding member shown especially in FIG. 6 consists of outer and inner folding fingers 76, 77 assigned to each bottom corner tab 27,28. All the folding fingers 76,77 for the two blanks 10 are arranged on a common supporting yoke 78 which is mounted centrally on a pivoting arm 79. The folding fingers 76,77 are arranged transversely relative to the longitudinal extension of the blanks 10 and respectively enter the region of the bottom corner tabs 27,28 from the free sides of the blanks 10. In the initial position, the folding fingers 76,77 are located on the underside of the blanks 10. As a result of the pivoting of the supporting yoke 78, the folding fingers 76,77 are moved upwards, thereby lifting and prefolding the bottom corner tabs 27,28.

During the downward movement of the blanks 10, the inner lid tab 18 to be laid round against the inner face of the lid front wall 17 is also preformed, specifically by a folding web 80 with an arcuate folding edge 81 (FIG. 10). During the downward movement of the blanks 10, the inner lid tab 18 slides along on this and is erected.

In the lower position of the blanks 10 in the pockets 32,33, a tab folder 82 is activated. This is designed at its free end with a folding piece 83 which grasps the erected inner lid tab 18 without any displacement and presses it into an oblique prefolding position relative to the lid front wall 17.

The tab folder 82 is likewise designed as a folding member common to the two blanks 10, with a fork-shaped end to which the folding pieces 83 are attached. A middle supporting arm 84 is mounted on a rotary axle 85 and is connected in transmission terms to the double ram 71. This connected via a link 86 is such that, during a cycle of movement of the double ram 71, the tab folder 82 is likewise moved downwards out of the initial position, represented by dot-and-dash in FIG. 10, into the folding position represented by unbroken lines.

As described, the blanks are transported on the blank tracks 39,40 by means of conveying rollers into the end position. When this is reached, the parts of the blanks 10 located at the rear in the direction of transport are in the region of a specially designed conveying roller 87 (FIG. 9). This is arranged relative to the end position of the blanks 10 in such as way that a reliable conveyance of of the blanks up to the limit stop 45 is guaranteed. As a result, parts of the blank 10, in the present case the front wall 12 and the outer side tabs 19,20, remain in the region of the covering roller 87.

In order nevertheless to guarantee that the blanks 10 are transported away transversely, the conveying roller 87 interacts with a (cylindrical) backing roller 88. The conveying roller 87 and backing roller 88 can be moved apart from one another slightly during the transverse conveyance of the blanks 10. Furthermore, the conveying roller 87 is designed with conveying ribs 89 and a supporting rib 90, of which the conveying ribs 89 located in the conveying path during the transverse conveyance of the blanks 10 have a sawtooth-shaped profile. The conveying ribs 89 on the one hand and the supporting ribs 90 on the other hand have different dimensions. Only the supporting rib 90 located at the edge rests against the outer surface of the backing roller 88, whereas between the conveying ribs 89 on the one hand and the backing roller 88 on the other hand there is a small gap 91 which nevertheless is of a smaller amount (for example, 0.15 mm) than the thickness of the blank (for example, 0.3 mm). The conveying effect is thereby guaranteed. Despite this, the blank is not jammed between the conveying ribs 89 and the backing roller 88.

The construction illustrated in FIG. 9 is chosen so that the conveying roller 87 is mounted in a fixed location on the machine stand 47, in particular via a driven roller shaft 92. The conveying roller 87 or the roller shaft 92 is driven via gear wheel 93.

The backing roller 88 which is (slightly) displaceable in parallel relative to the conveying roller 87 is mounted freely rotatably on a supporting axle 94. Here, the latter is mounted on the machine stand 47 on one side via a loadable supporting bearing 95. An axle portion 96 receiving the backing roller 88 is fastened excentrically, that is to say with an offset 97, to a bearing piece 98 of the supporting axle 94. As a result of the offset 97, an axis-parallel displacement of the backing roller 88 occurs when the supporting axle 94 or its bearing piece 98 is rotated.

On the side located opposite the supporting bearing 95, a control body 99 is mounted freely rotatably on the supporting axle 94. This control body 99 is equipped with a spur wheel 100 which is engaged with a further spur wheel 101 on the roller shaft 92. Also formed on the control body 99 is a cam piece 102. This runs on a circular and centrally mounted countercam 103 of the conveying roller 87.

The drive for the control body 99 is fixed so that, during a conveying cycle of a blank, the control body 99 executes a complete revolution. During this revolution, backing roller 88 is moved briefly away from the conveying roller 87, thus forming a slightly larger gap of, for example 0.6 mm which makes it possible for the blank to be conveyed away unobstructed in the axial direction, in particular from right to left in relation to FIG. 9. For this, a load is exerted in transverse direction on the control body 99 by means of the cam piece 102, with the engagement of the spur wheels 100 and 101 being maintained, with the result that the bearing piece 98 and consequently the supporting axle 94 as a whole are rotated a small angular amount because of the offset 97. This causes the backing roller 88 to be lifted off briefly.

To guarantee that the supporting axle 94 always returns to the initial position shown, the supporting axle 94 is preloaded towards the initial by means of a tension spring 104.

After the blanks 10 have been pressed into the two pockets 32,33 the erected part of the blank 10 (FIG. 10) is kept in position on the radially inner side of the pockets 32,33 by means of folding plates 105,106 which are arranged as a continuation of the stationary folding walls 75. The folding plates 105,106 extend at fixed location approximately level with the pockets 32,33. So that no constraints occur in the region of the folding plates 105,106 during the further movement, namely the rotation of the folding turret 31 by one stroke at least the folding plate 106 at the front in the direction of rotation of the folding turret can be moved back. For this purpose, the folding plate 106 is attached through a pivoting arm 107 which is mounted on one side and which can be moved by means of an actuating rod 108 out of the folding position represented by dot-and-dash lines in FIG. 11 into a retracted position represented by unbroken lines. In this last mentioned position, the two pockets 32,33 together with the partially folded blanks 10 can be moved past the folding plate 106 without obstruction.

We claim:

1. Apparatus for feeding blanks to a packaging unit, in the form of a folding turret, with pockets, each receiving a blank, the blanks being conveyable into a position above a pocket of the folding turret and being pressable into the upwardly open pocket as a result of a downward movement, characterized by the following features:

(a) means for pressing the blanks (10) in pairs into two respective pockets (32,33) of the folding turret (31) which are arranged next to one another, (b) means for simultaneously feeding the blanks (10) on separate blank tracks (39,40), the distance between these tracks being greater than the distance between the pockets (32, 33) of the folding turret (31), (c) means for moving the blanks (10), immediately before entering the pockets (32,33), towards one another, transversely relative to the blank tracks (39,40), to a distance corresponding to the distance between the pockets (32,33), in order to be pushed into the pockets (32,33) simultaneously.

2. Apparatus according to claim 1, characterized in that said pressing means comprises two simultaneously activated rams (68,69) which press the two blanks (10) into the pockets (32,33) from above, folding tabs or blank parts thereby being erected.

3. Apparaus according to claim 1 or 2, comprising endless conveyors for transporting the blanks (10) in the region of conveyance transverse relative to the blank tracks (39,40), each endless conveyor comprising two toothed belts (49,50) for respectively grasping a blank (10) on one longitudinal side of the latter.

4. Apparatus according to claim 1, comprising a limit stop for determining the position of the blanks (10) for transport transverse relative to the blank tracks (39,40), said limit stop being a lateral guide for the transverse transport of the blanks (10).

5. Apparatus according to claim 3, characterized in that the toothed belts (49, 50), each together with a drive wheel (51) and a deflecting wheel (52), are arranged on a supporting structure (53) above the path of movement of the blanks (10).

6. Apparatus according to claim 5, characterized in that the drive wheels (51) of the toothed belts (49,50) are mounted on drive shafts (56) which themselves are mounted fixed in place on a machine stand (47), each supporting structure (53) being pivotable about a drive shaft (56).

7. Apparatus according to claim 6, comprising platforms (46) on which the blanks (10) rest in the region of a pushing-in station (41), at an end position of the blank tracks (49,40), the blanks (10) being transversely displaceble on the platforms which are mounted on the machine stand (47) so as to project on one side.

8. Apparatus according to claim 7, characterized by an upper guide for the blanks (10) in the region of the end position on the blank tracks (39,40), said upper guide comprising a top plate (62) located at a short distance above each platform (46).

9. Apparatus according to claim 1, comprising a conveying roller (87) with a backing roller (88) for conveying the blanks at least in the final phase of conveyance on the blank tracks (39,40); and wherein, in order to execute the movement of the blanks transverse relative to the blank tracks (39,40), conveying roller (87) and backing roller (88) are movable apart from one another briefly as result of a lowering of the backing roller (88) located on the underside.

10. Apparatus according to claim 2, characterized in that the two rams (68,69) are combined to form a double ram (71) and are actuable by means of a common transmission in the form of of a crank mechanism (73).

11. Apparatus according to claim 2, characterized in that a vertical folding web (80) with an arcuate folding edge (81) is arranged above each of the pockets (32,33), in order to erect an inner lid tab (18) at the outer end of the blank (10) during the downward movement of the latter.

12. Apparatus according to claim 11, comprising tab folder means (82) for folding the inner lid tab (18) during the entry of the blank (10) into the pocket (32,33), said tab folder means (82) having a folding piece (83) located at its end, and being connected in transmission terms to the double ram (71).

13. Apparatus according to claim 1, characterized in that assigned to each pocket (32,33) on the radially inner side thereof, level with the pockets (32,33) are folding plates (105,106) of fixed location, the folding plate (106) at the front in the direction of rotation of the folding turret (31) being retractable out of the path of movement of the pockets (32,33) by pivoting inwards in the radial direction.

* * * * *